United States Patent [19]

Archer

[11] 4,296,693

[45] Oct. 27, 1981

[54] BEACH UMBRELLA SUPPORT

[76] Inventor: Richard W. Archer, 4/66 Beresford Rd., Rose Bay, New South Wales, 2029, Australia

[21] Appl. No.: 10,407

[22] Filed: Feb. 8, 1979

[51] Int. Cl.[3] ..... A47B 41/04; A47B 35/00

[52] U.S. Cl. ..... 108/28; 108/50; 248/158; 248/DIG. 10

[58] Field of Search ..... 108/28, 26, 50; 248/158, 346, 545, 523, DIG. 10

[56] References Cited

U.S. PATENT DOCUMENTS

| | | | |
|---|---|---|---|
| 1,936,428 | 11/1933 | Friesner | 108/50 X |
| 1,986,140 | 1/1935 | Dapp | 248/158 |
| 2,039,805 | 5/1936 | Knight | 108/50 |
| 2,195,391 | 3/1940 | Hunter | 108/50 UX |
| 2,883,247 | 4/1959 | Thompson | 108/50 UX |
| 3,216,681 | 11/1965 | Tagliavia | 248/346 X |
| 3,285,203 | 11/1966 | Meyer | 108/50 |
| 4,148,455 | 4/1979 | Oliver | 248/158 X |

FOREIGN PATENT DOCUMENTS

| | | | |
|---|---|---|---|
| 994741 | 2/1973 | Canada | 248/158 |

*Primary Examiner*—Roy D. Frazier
*Assistant Examiner*—Peter A. Aschenbrenner
*Attorney, Agent, or Firm*—Emory L. Groff, Jr.

[57] ABSTRACT

A beach umbrella support is formed by a collapsible container which can be filled with solid or liquid material to give it stability. Means are provided to retain the beach umbrella shaft in the container and the container itself can be provided with handles and pockets to double as a beach bag. Corner rods can be provided for additional stability and a table top can also be provided.

3 Claims, 2 Drawing Figures

BEACH UMBRELLA SUPPORT

The invention relates to an umbrella support and more specifically to a support for a sun shade commonly called a beach umbrella.

Such umbrellas are generally provided with a spiked shaft which is pushed into the beach sand. As the sand is rather loose, the umbrella can easily be turned over by a moderate breeze and serious accidents have been the result of such umbrellas being blown along the beach.

Various attempts have been made already to overcome these drawbacks by providing the spike with a thread to screw the umbrella shaft into the ground. Various types of plates at the spiked end have also been proposed, but none of these arrangements have proved to be successful, as in many cases the umbrella is first rotated by the wind thereby loosening its hold in the ground. It then requires only a minor wind force to topple the umbrella and drive it along the ground.

It is also known to provide a heavy stand for such umbrellas when the latter are used as sun shades on concrete surfaces. These stands consist generally of a heavy bottom plate of iron with a tube extending upwards therefrom to receive the umbrella shaft. The weight and size of such stands make them, however, unsuitable for use at the beach.

It has also been proposed to use a bag which can be filled with sand to stabilize the beach umbrella but such arrangements were also not successful.

It is an object of the present invention to provide a beach umbrella support which is easily transportable, prevents rotation of the umbrella by the wind and subsequent lifting and toppling over.

This object is achieved according to the invention by a beach umbrella support comprising a flat bottom collapsible container adapted to receive solid or liquid material, a tubular member extending centrally from the top of said container and adapted to receive the shaft of a beach umbrella, means to clamp said beach umbrella shaft to said tubular member and a central opening in the bottom of said container large enough to allow the beach umbrella shaft to pass therethrough.

Figure 1:
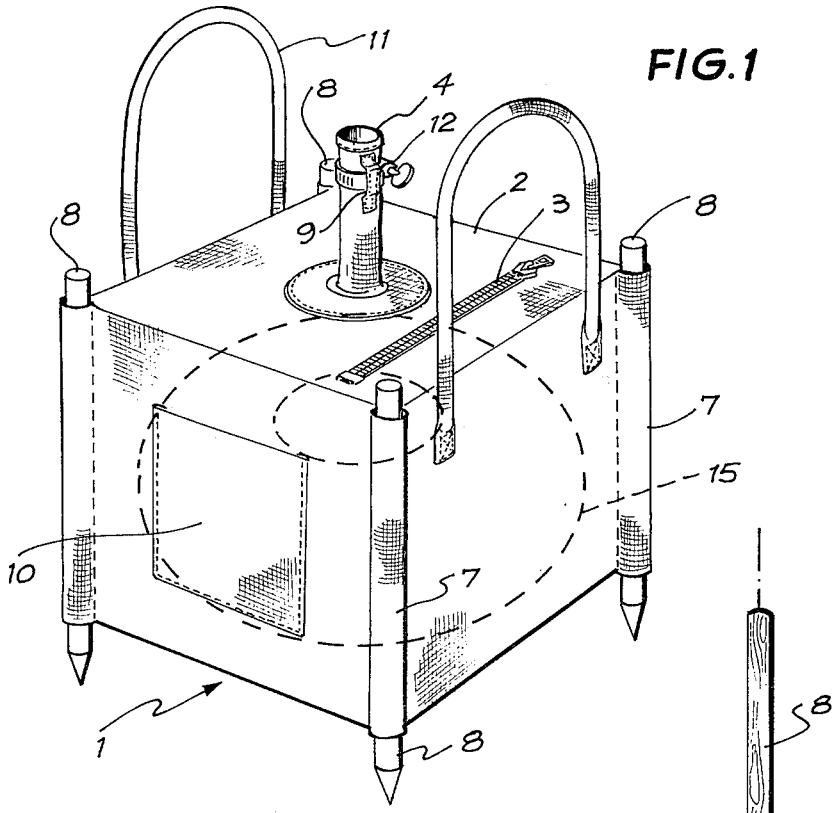
Figure 2:
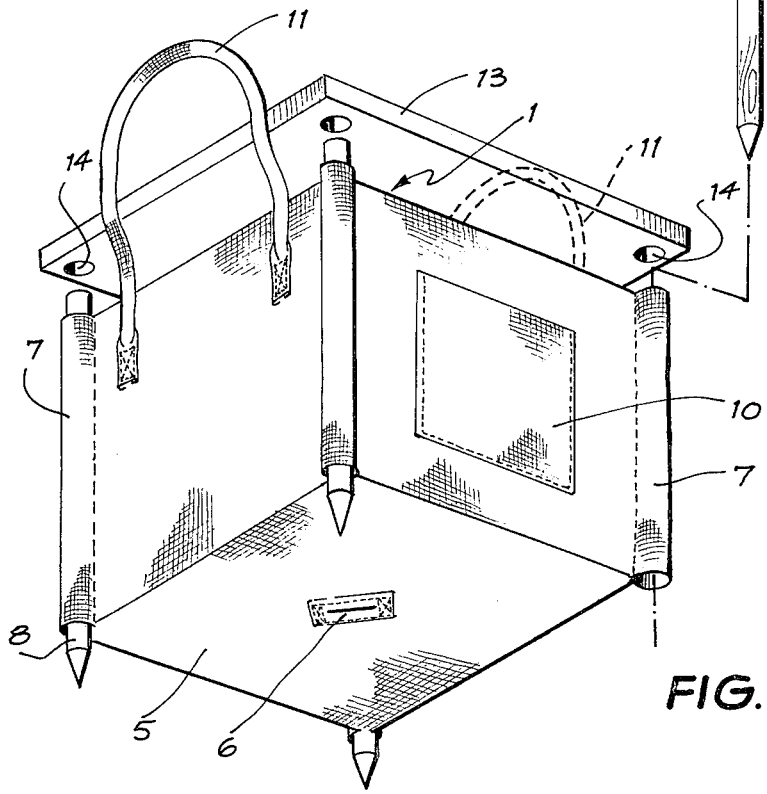

One embodiment of the invention will be described hereinafter in more detail in connection with the drawings in which:

FIG. 1 is a perspective top view of a beach umbrella support according to the invention and FIG. 2 is a bottom perspective view of the support shown in FIG. 1.

In this particular embodiment the container 1 forming the main support for the beach umbrella, has a substantially cubic shape, made from a heavy canvas or plastic material, so that it can be filled with sand. In case water is to be used as stabiliser a doughnut shaped bag 15 of waterproof material can be inserted in the container.

The top part 2 of the container has an opening closed by a zip fastener 3 which allows the container 1 to be filled or emptied. A tubular member or sleeve 4 is arranged centrally on the top part 2 of the container 1 and has an internal diameter large enough to receive an umbrella shaft with a loose fit. The tubular member or sleeve 4 is preferably made of the same material as the container. The bottom part 5 of the container has a reinforced slot 6 wide enough to allow the beach umbrella shaft to be pushed therethrough.

In some cases it is advantageous to facilitate filling of the container 1 by providing the four vertical edges with sleeves or pockets 7 retaining four vertical rods 8, which not only serve to stabilize the collapsible container 1 while it is filled, but can also serve as supports for a table top 13, which may be placed on top of the container after it has been filled.

This table top 13, which is made of any suitable material, has a central hole fitting over the abovementioned sleeve 4 and may have four recesses 14 engaging the corner rods 8 of the container 1.

The shaft of the beach umbrella is pushed through the sleeve 4 and the opening 6 in the bottom part 5 of the container and a clamp 9 with thumb screw 12 on the sleeve 4 secures the umbrella shaft in the sleeve 4 preventing any longitudinal as well as any rotating movement of the umbrella.

The container 1 can be made big enough to safely support a beach umbrella in normal wind forces, as it occupies only a very small space when it is in the collapsed state. It has been found that a container of one cubic foot will be sufficient for normal requirements.

If the container is made water tight or provided with a water tight insert as mentioned above the umbrella support can be used also in all places where sand is not readily available. It must be understood that other material, for example rocks, can also be used as filling.

The container 1 can be provided with additional pockets 10 and handles 11 so that it can be used as a beach bag before the beach umbrella is erected.

The foregoing detailed description deals only with one embodiment of the invention. It must be understood however, that modifications can be made in the shape of the container and the fixture of the umbrella shaft therein within the scope of the present invention.

I claim:

1. A support for the shaft of a beach umbrella comprising a flat bottom collapsible container adapted to receive solid or liquid material, said container having a top part with a filler opening therein, a tubular member extending centrally from the top part of said container and adapted to receive the shaft of said beach umbrella, means to clamp said beach umbrella shaft to said tubular member, a central opening in the bottom of said container large enough to allow said beach umbrella shaft to pass therethrough and a doughnut shaped water-tight insert in said container.

2. A support for the shaft of a beach umbrella comprising a flat bottom collapsible container adapted to receive solid or liquid material, said container having a top part with a filler opening therein, a tubular member extending centrally from the top part of said container and adapted to receive the shaft of said beach umbrella, means to clamp said beach umbrella shaft to said tubular member, a central opening in the bottom of said container large enough to allow said beach umbrella shaft to pass therethrough, a sleeve at each of the four vertical corners of the container and a rod in each of said sleeves extending beyond the top and the bottom of said container.

3. A support for the shaft of a beach umbrella according to claim 2 and including a table top mounted on said rod, said table top having a central opening fitting over the beach umbrella shaft, and said rods engaging corresponding recesses in said table top.

* * * * *